United States Patent [19]

Dokoupil

[11] 4,100,771

[45] Jul. 18, 1978

[54] METHOD AND APPARATUS FOR FLEXIBILIZING LEATHER

[76] Inventor: Jiri Dokoupil, Hochstrasse 9, D-6251 Gückingen, Germany

[21] Appl. No.: 724,771

[22] Filed: Sep. 20, 1976

[30] Foreign Application Priority Data

Sep. 29, 1975 [DE] Fed. Rep. of Germany ..... 2543412

[51] Int. Cl.[2] ..... C14B 1/40

[52] U.S. Cl. ..... 69/33; 69/21

[58] Field of Search ..... 69/33, 34, 40, 216

[56] References Cited

U.S. PATENT DOCUMENTS

| | | | |
|---|---|---|---|
| 73,408 | 1/1868 | Tidd | 69/33 |
| 1,600,957 | 9/1926 | Harding | 69/34 |
| 2,646,676 | 7/1953 | Campbell | 69/34 |
| 3,398,557 | 8/1968 | Dokoupil et al. | 69/33 |

FOREIGN PATENT DOCUMENTS

| | | | |
|---|---|---|---|
| 1,448,355 | 9/1976 | United Kingdom | 69/33 |
| 297,674 | 5/1977 | U.S.S.R. | 69/33 |

*Primary Examiner*—Alfred R. Guest

*Attorney, Agent, or Firm*—Werner W. Kleeman

[57] ABSTRACT

A method of, and apparatus for, flexibilizing or softening leather or like materials wherein opposite marginal regions or lines of at least one area section of the piece of material to be worked and extending at least partially over such piece of material are moved periodically in relation to each other. This relative movement comprises or consists of a movement component directed parallel to the plane of said piece of material. This can be achieved by means of at least two tools moved appropriately in relation to each other and acting on the material by imposing an alternating deformation thereon comprising a movement component parallel to the plane of the piece of material.

24 Claims, 11 Drawing Figures

FIG.1
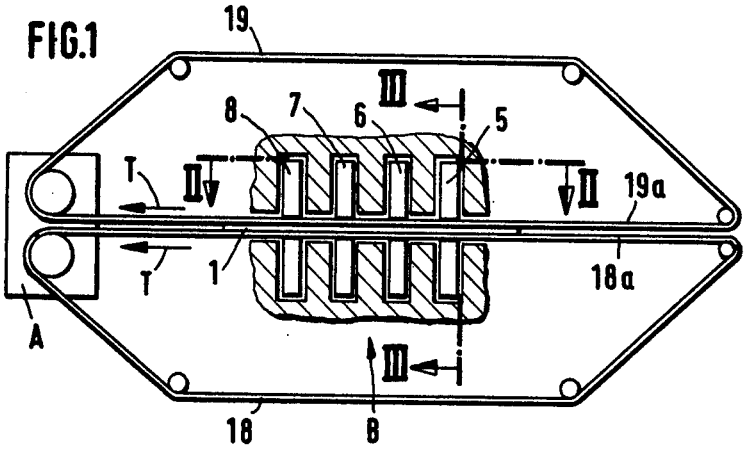
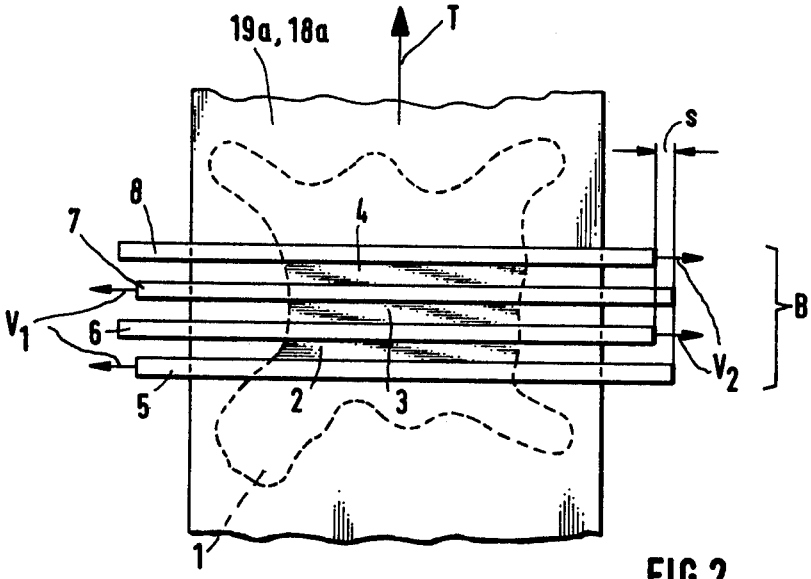
FIG.2

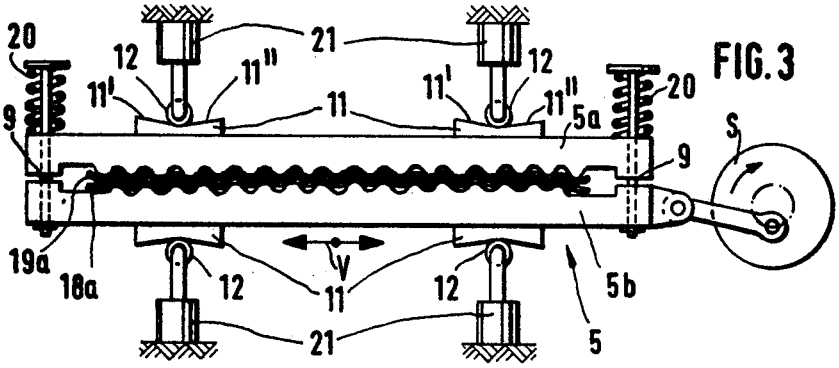
FIG. 3
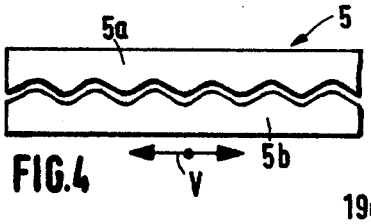
FIG. 4
FIG. 6
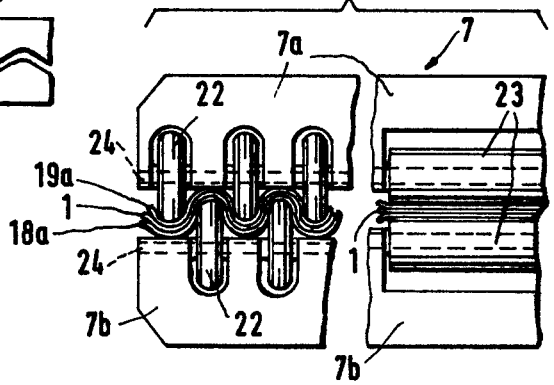
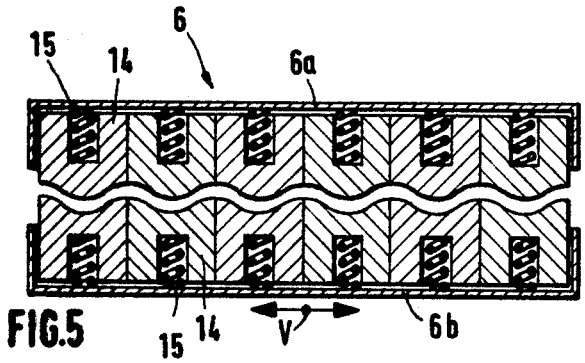
FIG. 5
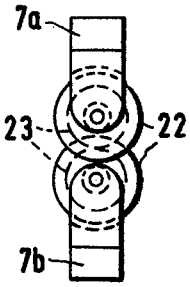
FIG. 6a
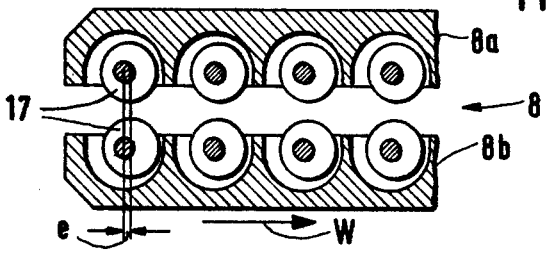
FIG. 7

FIG.8
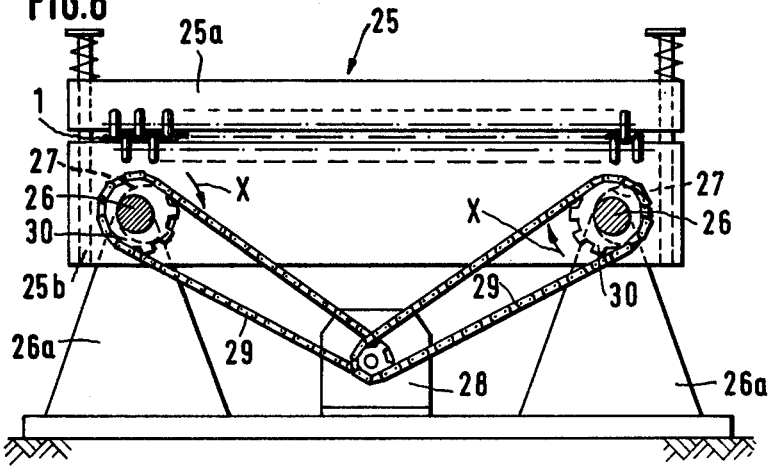
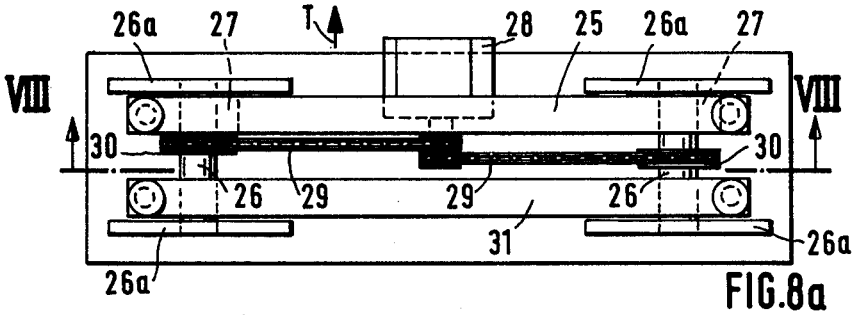
FIG.8a
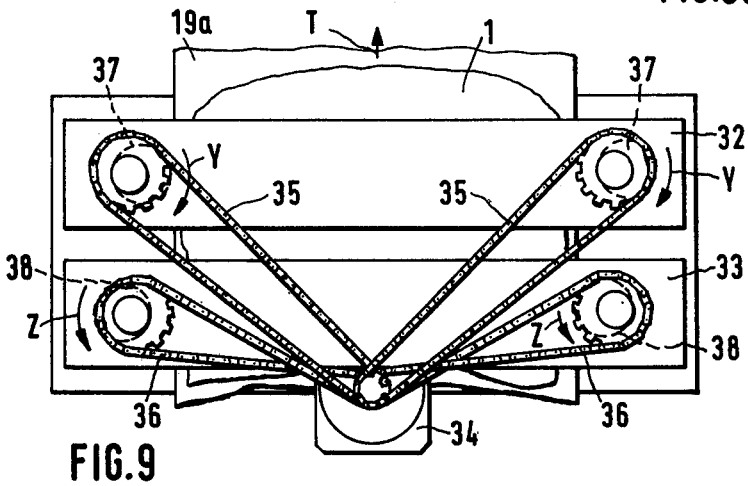
FIG.9

METHOD AND APPARATUS FOR FLEXIBILIZING LEATHER

BACKGROUND OF THE INVENTION

The present invention relates to a new method of flexibilizing or softening leather or the like material wherein a piece of the material is deformed alternatingly in the course of a transport movement. The invention furthermore is concerned with apparatus for the same purpose wherein at least two tools are moved relatively to each other for imposing an alternating deformation on a piece of the material.

Flexibilization of leather by means of alternating deformation is known in the art, e.g. from the U.S. Pat. No. 73408 - 1/1868 to TIDD showing alternating deformation of leather by means of tool projections meshing through the deformed material. This means that the deformation substantially consists of bending and cambering the material transversely to the plane of the piece of material (henceforth called "plane of the piece" for the sake of simplicity).

Certain kinds of leather which exhibit comparatively great elasticity already in their initial condition and, therefore, are capable of sustaining the enforced extension within small area sections due to the said bending and cambering can be sufficiently flexibilized with the known method. In general, however, efficiency of flexibilization through alternating deformation and its applicability for less elastic materials is open to substantial enhancement.

SUMMARY OF THE INVENTION

Hence, it is a primary object of the present invention to provide a new and improved method of, and apparatus for, flexibilizing or softening leather or like materials which exhibit greater efficiency and broader applicability as compared with flexibilization merely by transverse alternating deformation.

Another and more specific object of the present invention aims at the provision of a new and improved method of, and apparatus for, flexibilizing leather and like materials which renders possible high degrees of deformation and flexibilization for comparatively weak and inelastic materials with a highly efficient operation.

Now in order to implement these and still other objects of the invention, which will become more readily apparent from the further description, the methods aspects of the present invention contemplate moving opposite marginal ranges of at least one area section extending at least partially over said piece of material periodically in relation to each other, and this relative movement at least comprising a component directed essentially parallel to the plane of said piece of material.

The apparatus aspects of the present invention correspondingly contemplate tools extending over the piece of material and being arranged at a mutual distance from one another in a direction parallel to the plane of the piece of material, and the running or travel path of said tools comprising at least in one section thereof a component directed substantially parallel to the plane of the piece of material.

In this context the best mode of operation of the method and apparatus according to the present invention is considered to employ deformation area sections and tools which correspondingly extend longitudinally transversely to a direction of transportation of the piece of material and moved periodically in opposite direction relatively to each other at the marginal ranges or lines of said area sections. Thus the deformation is substantially bending and/or shearing parallel to the "plane of the piece", while enforced extension of the material is avoided.

However, presence of alternating deformation and corresponding movement of the tools parallel to the "plane of the piece" as such is essential for obtaining desirable results, while additional components of deformation and tool motion transversely to the "plane of the piece" may be tolerable or even advantageous in certain applications. Thus it is sufficient that a component of said deformation or tool motion is parallel to the "plane of the piece", possibly only in certain sections of the motion or travel path of the tools.

Furthermore, it is preferable to have tools extending over the complete width of a piece of material to be flexibilized, while in certain cases smaller tools covering merely a part of said width may be desirable, the whole piece then being worked on in several operations.

BRIEF DESCRIPTION OF THE DRAWINGS

The invention will be better understood and objects other than set forth above, will become apparent from the following description which makes reference to the annexed drawings wherein:

FIG. 1 schematically illustrates an apparatus constructed according to the invention for flexibilizing leather, in side elevational view;

FIG. 2 shows a sectional view of the apparatus of FIG. 1 according to the section plane II—II in FIG. 1;

FIG. 3 shows a sectional view according to the section plane III—III in FIG. 1 with a front elevation of a flexibilization tool in greater detail;

FIG. 4 shows a front elevation of the tool of FIG. 3 in a greater scale of presentation with profiled driver means;

FIG. 5 illustrates a further development of the tool according to FIG. 2 in a sectional view with the section plane transverse to the direction of transport;

FIG. 6 shows another tool with rotating elements as driver means acting on the material;

FIG. **6*a* is a side view of the tool according to FIG. 6** seen in a direction transverse to the direction of transport;

FIG. 7 illustrates a further tool embodiment having driver means self-locking in a direction transverse to the direction of transport;

FIG. 8 is a sectional view of a further embodiment of an apparatus constructed according to the invention, the section plane being along line VIII—VIII in FIG. **8*a***;

FIG. **8*a* is a top view of the apparatus according to FIG. 8**; and

FIG. 9 shows another embodiment of an apparatus according to the invention in a top view.

DETAILED DESCRIPTION OF THE INVENTION

The apparatus according to FIG. 1 comprises two transport belts 18 and 19 with co-operating sections **18*a* and 19*a* for transporting a piece 1 of leather to be worked on. The belts together with a motor unit A form the drive or transport device of the apparatus. The piece 1 is moved through flexibilization station B comprising tools 5 through 8** arranged one behind the other in the transport direction T. On principle merely one belt could also be used for carrying the piece of material through the station B. Putting in of the material pieces for flexibilization by hand or other devices would also be possible for minor operation ratings.

The tools are formed to be longitudinally extending over the width of complete pieces of material undergoing processing and transversely with respect to the direction or transport T. They are arranged at a mutual spacing or distance from one another parallel to the "plane of the piece" and to the transport direction T, and they carry out oscillating movements illustrated by arrows $V_1$, $V_2$ parallel to the "plane of the piece" and transversely to the transport direction T in opposite direction in relation to each other. Thus while in motion they entrain opposite marginal ranges or lines of area sections 2 through 4 shown in FIG. 2 along with them in said antiparallel motion, the area sections also being longitudinal in shape and located between two of said tools each. Thus the said area sections are deformed by shearing and bending substantially in or parallel to the plane of the piece. Additional components of the tool motion and of the deformation transverse to the "plane of the piece" as well as parallel to the direction of transport T may be carried out. As merely the motion of the tools in relation to each other is relevant, each pair of tools may comprise one arranged immovable which offers advantages with regard to expenditure in certain cases.

The maximum deformation of the material is defined by the ratio between the amplitude s of the relative tool motion and the mutual distance of two tools located next to each other as shown in FIG. 2. Furthermore, the number of deformations reached by each area element of the material in the course of operation has a substantial influence upon the final degree of flexibilization. Therefore, it is preferred to have the velocity of said relative motion i.e. the speed of one tool relative to a neighboring coacting tool of a pair as great as possible, especially as great as a high multiple of the transportation velocity speed of the material being processed.

Now different tool embodiments are explained, for the sake of simplicity while employing the reference numerals 5 through 8 of FIG. 1 for the tools shown in FIGS. 3 through 7.

The tool of FIG. 3 bearing the reference number 5 has two driver means 5*a* and 5*b* acting on the outer sides of the belt sections 18*a* and 19*a* with the piece 1 and carrying the latter with them in the direction of arrow V. This motion is introduced by means of a drive S having a crank-shaft gear. In order to enable the relative motion of neighbouring tools the belts have a greater elastic deformation capacity being sheared in parallel to the "plane of the piece" than in case of being extended. Elastic deformation capacity may be especially great for shearing transversely to the direction of transport.

Within the tool 5 driver means 5*a* and 5*b* are arranged movable transversely to the "plane of the piece" by means of guides 9 in relation to each other, and they are pressed together and against the belt sections 18*a*, 19*a* by pressure springs 20. The pressure has to be adjusted so as not to impede the transport motion too much. It is possible to use a periodically variable pressure acting on the tools, then the transportation being concentrated more or less in the time intervals of reduced pressure and friction between the tools and the belts.

FIG. 3 shows such periodically variable pressurizing device for the tool 5 and its driver means in dependence on the oscillating tool motion. Pressurizing means 21 are acting through rollers 12 on wedge-shaped guides or cams 11 at the driver means 5*a*, 5*b*. Oppositely inclined sections 11' and 11" thereof together with a progressive spring pressure effect the desired periodic driver means pressurizing with the minimum pressure coinciding with zero deformation or deformation changing its direction.

Furthermore, driver means 5*a* and 5*b* are forming complemental projections and grooves and projections within a wave-like profile. The projections and grooves are meshing through the deformed material, thus enhancing the drive effect transversely to the transport direction, while the profile surface being linear in parallel to the transport direction has a lesser friction with the belts in this direction. Thus the driver means in their moving action on the material are of a lesser tangential driving capacity in the direction parallel to the transport direction as compared with the direction transverse to the direction of transport.

FIG. 5 shows a tool 6 with an upper part 6*a* and a lower part 6*b*, both carrying a plurality of driver means 14 with individually co-ordinated pressure springs 15. This embodiment offers enhanced adaption to changing thickness and irregularities of the material.

FIGS. 6 and 6*a* illustrate driver means formed as trundles 22 and rollers 23 mounted rotatably on shafts or axes 24 in an upper and lower part 7*a* and 7*b* respectively, of tool 7. Such rotating elements as driver means offer especially advantageous a ratio between the drive capacity parallel to the transport direction and the transverse direction as explained above.

The driver means 5*a*, 5*b*, 14 and 22 are meshing with projections and grooves from both sides of the transport belts, thus adding curvature and flexure of the material transversely to the "plane of the piece". This may enhance flexibilization as explained already.

FIG. 7 shows a tool 8 with the upper and lower parts 8*a* and 8*b*, respectively, bearing rotatable or swinging driver means 17 with axes or shafts arranged in parallel to the transport direction. Excentricity e of these roller-like driver means effects a self-locking action in contact with the belt or material surface only in one direction of rotation and tool motion, while the self-locking connection between the tool and the belts or the material is cancelled in the opposite direction, thus setting free the transport movement.

The apparatus of FIGS. 8 and 8*a* comprises tools 25 and 31 similar to FIG. 3. The upper and lower parts 25*a* and 25*b*, respectively, of tool 25 carries rotating driver means according to FIG. 6. In the lower part 25*b* there are two driving shafts 26 with excenter rolls or hubs 27, on which the lower part is mounted, and the whole tool therewith. Shafts 26 are rotatably mounted in immovable carriers 26*a*, and are driven from a motor 28 via chains 29 and wheels 30 in synchronism in the direction of arrows X. Thus tool 25 performs a circular translation with the given excentricity as the radius, and in a plane oriented substantially transverse to the transport direction T. Thus tool 25 performs a motion comprising the desired oscillating component parallel to the "plane of the piece". The additional component acting transversely to this plane in this case is comparatively strong which restricts the scope of application.

The second tool 31 shown in FIG. 8*a* as such is of similar construction, but without any eccentric mounting, i.e. mounted immovably on the frame. Thus the necessary retative motion of both tools is ensured.

The apparatus of FIG. 9 comprises two tools 32 and 33 similar to FIG. 3 and FIG. 6, and with an excenter or eccentric mounting and drive according to FIG. 8 including a motor 34 and two pairs of chains 35 and 36, respectively, as well as excenter or eccentric means 37, 38. The tools perform a circular translation in planes parallel to the "plane of the piece" with opposite circular running direction according to arrows Y and Z. Thus the mutual distance of the tools remains constant as far as the transport direction or the one transverse to the deformation movement is concerned, provided there is synchronism of the eccentric rotation. If further the motion component parallel to the transport direction has no effect on the belt surface due to rotating driver means with axes transverse to the transport direction, the path and motion component parallel to the "plane of the piece" remains effective alone.

The circular motion may be fully rotating or swinging with respect to the excenter or eccentric means, the latter being especially advantageous in certain cases with regard to the structure. In any case, there are at least two swinging or rotating link guide means such as eccentric means or the like for defining the path of motion of the tools, the plane of motion being oriented as just explained. Equal radii of said link guide means lead to a motion like a parallelogram, while different radii induce additional rotation or swinging components into the tool motion, which may be desirable in certain cases.

Accordingly, what is claimed is:

1. In a method of flexibilizing or softening leather or the like material, comprising alternatingly deforming a piece of the material in the course of transport movement, the improvement which comprises the steps of: moving opposite marginal ranges of at least one area section extending at least partially over said piece of material periodically relative to each other, said relative movement at least comprising a component directed essentially parallel to the plane of said piece of material, whereby said piece of material is subjected to at least shearing forces essentially parallel to the plane of said material.

2. The method as defined in claim 1, in which the velocity of said relative movement imposed in the material is a multiple of the transportation velocity of the material.

3. The method as defined in claim 2, wherein the transportation velocity is periodically variable, and the transport movement is concentrated at least partially in time intervals in which the direction of said deformation changes in the course of alternation.

4. The method as defined in claim 1, wherein said opposite marginal ranges include at least one marginal region extending substantially linearly, and said relative movement is carried out essentially parallel to said linearly extending marginal region.

5. An apparatus for flexibilizing or softening leather or the like material, comprising at least two spaced tools for entraining an area section of said material therebetween, means for moving at least one of said tools in a direction opposite to said other tool and transverse to the direction of travel of said material for imposing an alternating deformation on a piece of said material, said tools extending at least partially over the piece of material and arranged at a mutual spacing from one another in a direction substantially parallel to the plane of the piece of material, said moving means imparting a path of travel to said tools comprising at least in one section thereof a component directed essentially parallel to the plane of the piece of material, said moving tools imparting at least shearing forces to said material essentially parallel to the plane of said material to cause flexibilizing deformation of said material being entrained by said tools.

6. The apparatus as defined in claim 5, wherein said moving means comprises at least one of said tools being coupled with a drive generating a relative movement of at least said two tools which are located next to each other, said relative movement being periodical and at least partially in opposite direction with respect to the tools located next to each other and comprising at least a component directed essentially parallel to the plane of said piece of material.

7. The apparatus as defined in claim 5, wherein said at least two tools extend longitudinally and are arranged substantially parallel to each other and comprise driver means acting on the piece of material for imposing said alternating deformation.

8. The apparatus as defined in claim 7, in which transport means are provided for transporting each piece of material through a flexibilizing station comprising said tools, said tools extending in their longitudinal direction at least approximately transverse to the direction of transportation of each piece of material.

9. The apparatus as defined in claim 8, in which the tools extend in their longitudinal direction over the complete width of each of the pieces of material to be flexibilized.

10. The apparatus as defined in claim 5, wherein said tools comprise at least one tool comprising driver means arranged on both sides of the material to be flexibilized and pressed in opposite directions relative to each other against the material.

11. The apparatus as defined in claim 10, in which said driver means form a plurality of projections and grooves.

12. The apparatus as defined in claim 11, in which said driver means form projections and grooves meshing with each other through the material.

13. The apparatus as defined in claim 5, further including transport means provided for moving pieces of material through a flexibilizing station comprising said tools, at least one of said tools having movable driver means acting on the material, said driver means during their moving action on the material possessing a lesser tangential driving capacity in a direction parallel to the direction of transportation as compared with the direction transverse to the direction of transportation.

14. The apparatus as defined in claim 13, in which said driver means comprise rotating elements having their axis of rotation arranged at least approximately transverse to the direction of transportation.

15. The apparatus as defined in claim 5, wherein at least one tool comprises driver means arranged rotatably with their axis substantially parallel to the direction of transportation, said driver means forming a self-locking connection with the material when acting thereon under rotation in one of both directions of rotation.

16. The apparatus as defined in claim 5, wherein at least one of said tools is provided with pressurizing means of periodically variable pressure acting in a direction against the material.

17. The apparatus as defined in claim 16, including means for varying said pressure acting on the material in dependence on the alternating operation of said tool.

18. The apparatus as defined in claim 5, in which an elastically deformable transport belt is arranged between the material to be flexibilized and each tool.

19. The apparatus as defined in claim 18, in which there said transport belt has an elastic shear deformation capability which is greater as compared with the elastic tensile deformation capability.

20. The apparatus as defined in claim 19, wherein said elastic shear deformation capability is great in a direction transverse to the direction of transportation of each piece of material.

21. An apparatus for flexibilizing or softening leather or the like material, comprising at least two tools, means for moving said tools relative to each other for imposing an alternating deformation on a piece of said material, said tools extending at least partially over the piece of material and arranged at a mutual spacing from one another in a direction substantially parallel to the plane of the piece of material, said moving means imparting a path of travel to said tools comprising at least in one section thereof a component directed essentially parallel to the plane of the piece of material further including means for reciprocating said tools including a rotating link guide, at least one of said tools is mounted rotatably for full or partial rotation in relation to a frame by means of at least two swinging or rotating link guide devices.

22. The apparatus as defined in claim 21, in which said swinging or rotating link guide devices are arranged to be movable in a plane extending at least approximately transverse to the direction of transportation.

23. The apparatus as defined in claim 21, in which said swinging or rotating link guide devices are arranged to be movable in a plane extending at least approximately parallel to the plane of the piece of material to be flexibilized.

24. An apparatus for flexibilizing or softening leather or the like material comprising a plurality of adjacent work stations, each station having a pair of cooperating tool elements carrying interengaging projecting elements for entraining portions of said piece of material being flexibilized, means for moving the pairs of elements with a movement component parallel to the work plane while at the same time imparting a movement substantially perpendicular for gripping said material to effect entrainment of the material between adjacent tools.

* * * * *